US005319280A

United States Patent [19]

Vriens

[11] Patent Number: 5,319,280

[45] Date of Patent: Jun. 7, 1994

[54] COLOR PICTURE TUBE WITH REDUCED RASTER DISTORTION AND FLAT APPEARING DISPLAY WINDOW

[75] Inventor: Leendert Vriens, Eindhoven, Netherlands

[73] Assignee: U.S. Philips Corporation, New York, N.Y.

[21] Appl. No.: 865,524

[22] Filed: Apr. 9, 1992

[30] Foreign Application Priority Data

May 6, 1991 [EP] European Pat. Off. ..... 91201072.5

[51] Int. Cl.[5] ..... H01J 29/86

[52] U.S. Cl. ..... 313/413; 220/2.1 A; 313/477 R; 313/408

[58] Field of Search ..... 313/413, 477 R, 408; 220/2.1 A, 2.3 A, 2.1 R, 2.3 R

[56] References Cited

U.S. PATENT DOCUMENTS

| | | | |
|---|---|---|---|
| 4,537,322 | 8/1985 | Okada et al. | 220/21 A |
| 4,777,401 | 10/1988 | Hosokoshi et al. | 313/477 R |
| 4,887,001 | 12/1989 | D'Amato et al. . | |
| 4,924,140 | 5/1990 | Hirai et al. | 313/477 R |
| 4,943,754 | 7/1990 | Hirai et al. | 313/477 R |
| 4,985,658 | 1/1991 | Canevazzi | 313/477 R |
| 5,107,999 | 4/1992 | Canevazzi | 313/477 R |
| 5,151,627 | 9/1992 | Van Nes et al. | 313/477 R |

FOREIGN PATENT DOCUMENTS

| | | | |
|---|---|---|---|
| 0421523 | 9/1990 | European Pat. Off. . | |
| 3432677 | 4/1985 | Fed. Rep. of Germany . | |
| 2243945A | 11/1991 | United Kingdom | 313/477 R |

*Primary Examiner*—Sandra L. O'Shea
*Assistant Examiner*—Vip Patel
*Attorney, Agent, or Firm*—Robert J. Kraus

[57] ABSTRACT

A display device having a rectangular display window with a major and a minor dimension, and a deflection unit producing a scanning line raster on a display screen on the inner surface of the display window, the scan lines extending in the minor direction. The inside surface of the display window has a major radius of curvature ($R_{cmajor}$), a minor radius of curvature ($R_{cminor}$), a diagonal dimension (D) and an aspect ration (A), which parameters are related by the formulas $1.1 < R_{cminor}/D < 2.5$, also $2.5 < R_{cmajor}/D$, also $R_{cmajor} > A*R_{cminor}$. The display window is thereby very flat and scanning line raster distortion is reduced so that it is easily correctible by the deflection fields produced by the deflection unit.

8 Claims, 1 Drawing Sheet

COLOR PICTURE TUBE WITH REDUCED RASTER DISTORTION AND FLAT APPEARING DISPLAY WINDOW

BACKGROUND OF THE INVENTION

1. Field of the Invention

The invention relates to a display device comprising a display tube having a rectangular display window with a short axis and a long axis and an inside surface on which a display screen is provided, electron gun means for generating at least one electron beam and which is arranged opposite the display screen, and a deflection system located between the electron gun means and the display screen. Such display devices are used in, inter alia, television receivers and computer monitors.

2. Description of the Related Art

A problem with this type of display devices is so-called raster distortion. Due to raster distortion, a straight line is reproduced as a curved line on the display screen. In future HDTV systems this problem will become more serious. Such systems employ higher line and field scanning frequencies than the conventional systems and generally have a larger display screen. Raster distortion is more conspicuous in relatively large display screens, and is difficult to correct at comparatively high frequencies. In general, correcting raster distortion becomes more difficult according as the flatness of the display window increases.

SUMMARY OF THE INVENTION

It is an object of the invention to provide a display device of the aforesaid type in which the raster distortion problem has been reduced.

To this end, a display device according to the invention is characterized in that the deflection system comprises a first deflection coil system for generating, in the energized state, a substantially pincushion-shaped line deflection field for deflection in the direction of the short axis of the display screen, and a second deflection coil system for generating, in the energized state, a substantially barrel-shaped vertical deflection field for deflection in the direction of the long axis of the display screen, and in that the inner radius of curvature along the short axis of the display screen $R_{cminor}$ is given by:

$$1.1 < R_{cminor}/D < 2.5$$

where D is the length of the diagonal of the display screen, and in that the inner radius of curvature along the long axis of the display screen $R_{cmajor}$ and the aspect ratio A, i.e. the ratio between the long axis and the short axis of the display screen, are given by:

$$2.5 < R_{cmajor}/D$$

$$R_{cmajor} > A * R_{cminor}$$

and $$A \geqq 4/3$$

The invention is, inter alia, based on the following insights:

The most disturbing raster distortion is formed by a curvature of the field lines in the direction perpendicularly to the line scanning direction. In conventional display tubes, lines are scanned in a direction parallel to the long axis. Said direction will hereinafter also be referred to as the horizontal direction or E-W (east-west) direction. Such display devices often comprise a deflection system having a first deflection coil for generating, in the energized state, a substantially pincushion-shaped line deflection field for deflection in the direction of the long axis of the display screen and a second deflection coil for generating, in the energized state, a substantially barrel-shaped vertical deflection field for deflection in the direction of the short axis of the display screen. Such fields have a positive effect on raster distortion, both in monochrome display devices and in colour display devices. However, raster errors cannot be prevented completely. Usually, the raster distortions in the direction transversely to the line scanning direction are approximately 4% in the lowest order, which can be partly compensated by higher-order terms. However there remains a certain degree of raster distortion due to the difference between the orders. Said raster distortion will generally be a pincushion-shaped distortion in the central part of the image. It is noted, that in the case of colour display devices the electron beams are usually generated by a so-called in-line electron gun for generating three electron beams extending in one plane parallel to the long axis. Deflection fields as described above have a further positive effect in such colour display devices, which resides in that the display device is self-convergent.

Raster distortions can be corrected by electronically correcting the deflection of the electron beams. In conventional display devices, in particular, a correction of the raster distortion in the vertical direction (along the short axis) is problematic because it requires a high-frequency correction the frequency being equal to the line scanning frequency to be carried out on the low-frequency vertical deflection field. The invention relates to a rotation of the deflection system through 90° in combination with certain conditions concerning $R_{cminor}$ and $R_{cmajor}$ and A.

When the deflection system is rotated through 90°, the most important problem with respect to raster distortion is the raster distortion in the horizontal direction (along the long axis of the display screen). A correction of said raster distortion requires a high-frequency correction of a low-frequency signal. An analysis of said raster distortion, which will hereinafter also be referred to as $\Delta_{EW}$, which analysis is carried out within the framework of the invention, teaches that $\Delta_{EW}$ is approximately given by:

$$\Delta_{EW} = \delta_1 * y^2 + \delta_2 * y^2 * x^2 + \delta_3 * y^4$$

where $\delta_1$, $\delta_2$ and $\delta_3$ are constant coefficients. For the sake of simplicity, said raster distortion $\Delta_{EW}$ in the direction transversely to the line scanning direction will hereinafter also be referred to as "the raster distortion(s)". An electronic correction of the raster distortion can be carried out in a simple manner when $\delta_1 * y^2$ is small. In the case of a large value of $\delta_1 * y^2$, the resultant raster distortion can only partly be compensated by higher-order corrections and, in addition, only in a part of the screen, by carrying out several higher-order corrections, which is difficult. $\delta_1 * y^2$ is small for the indicated range of $R_{cminor}/D$, i.e. smaller than approximately 2% so that corrections can be carried out in a simple manner.

The analysis carried out within the framework of the invention further shows that the coefficients $\delta_1$ and $\delta_3$ are independent of the radius of curvature $R_{cmajor}$. An aspect of the invention is based on the insight that the display window can be of a flatter construction in the horizontal direction than conventional display windows, without this having an adverse effect on the raster distortion. In the indicated range of $R_{cmajor}$, the display window is of a flatter construction in the horizontal direction than conventional display windows. Further, in particular, the ratio $R_{cmajor}/R_{cminor}$ is greater than usual. The indicated conditions for $R_{cminor}$, $R_{cmajor}$ and A strengthen the visual impression that the display window is flat, because the sagittal height z at the end of the short axis and the sagittal height at the end of the long axis will differ only slightly from each other. Preferably, the electron gun means for generating at least one electron beam in a colour display device is an electron gun for generating three electron beams extending in one plane parallel to the short axis. In this case, also the plane of the gun is rotated.

A further preferred embodiment of the invention is characterized in that:

$$A^{3/2}R_{cminor} < R_{cmajor} \leqq A^2 R_{cminor}$$

In this case, the sagittal heights at the end of the short axis and the long axis differ little from each other.

A preferred embodiment of the display device according to the invention is characterized in that $$2.5 < R_{cdiagonal}/D$$

and $$R_{cdiagonal} > \sqrt{(A^2+1)} * R_{cminor}$$

where $R_{cdiagonal}$ is the radius of curvature along the diagonal of the display screen. Said embodiment is based on the insight that $\Delta_{EW}$ is governed only to a small degree by the radius of curvature along the diagonal when the radii of curvature along the short and long axes remain constant, so that it is also possible to manufacture the display window in such a manner that it is flatter along the diagonal than conventional display windows, when the line scanning device extends parallel to the short axis.

Preferably, it holds that:

$$R_{cmajor} \leqq R_{cdiagonal} \leqq (1+A^{-2}) * R_{cmajor}$$

In this case, the sagittal height at the end of the long axis and at the end of the diagonal differ only slightly from each other. This strengthens the impression that the display window is flat.

Preferably, the sagittal height along the short sides of the display window is approximately constant, for example, the sagittal height along the short sides varies less than 2.5% relative to the length of the short axis. If the sagittal height along the short side is not constant, a straight line represented along the short side is perceived as a curved line by a viewer looking at the display window at an angle. This leads to an apparent raster distortion. This effect is small when the sagittal height is approximately constant along the short sides. The apparent raster distortion is most clearly visible along the short sides because, in general, the divergence of the viewing angle is greater in the horizontal direction than in the vertical direction.

The combination of the above-mentioned conditions for the radius of curvature along the long axis and along the diagonal enables the manufacture of a very flat display window whose sagittal height along the sides of the display window is approximately constant, thus giving the display window a very flat appearance while the apparent raster distortion along the sides is reduced.

BRIEF DESCRIPTION OF THE DRAWINGS

The invention will be explained in greater detail by examples of embodiments of the display device according to the invention with reference to the accompanying drawings, in which.

The Figures are not drawn to scale. In the Figures, corresponding parts generally bear the same reference numerals.

DESCRIPTION OF THE PREFERRED EMBODIMENTS

Figure 1:
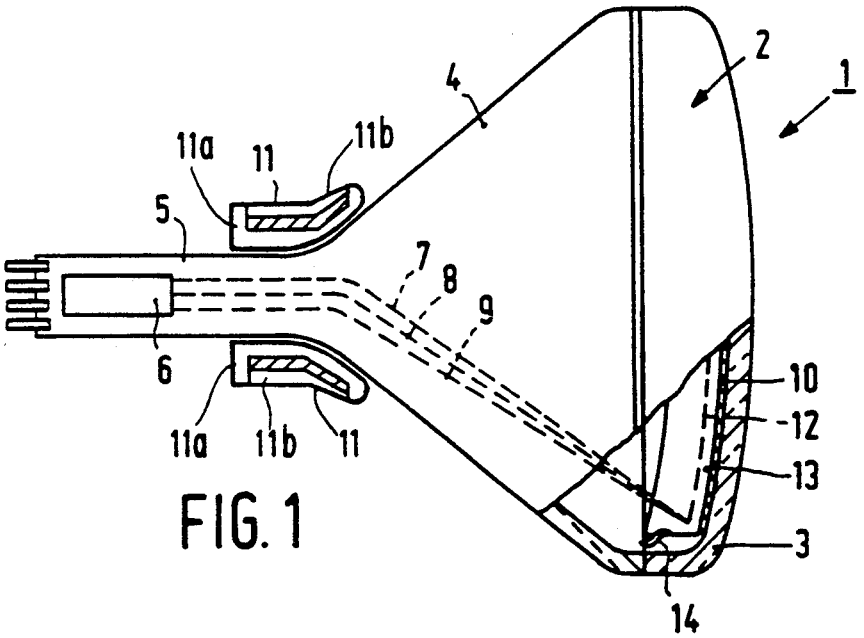
FIG. 1 is a longitudinal cross-sectional view of a display device according to the invention.

The display device, in this example colour display device 1, comprises an evacuated envelope 2 which consists of a display window 3, a cone portion 4 and a neck 5. In the neck 5 there is provided an electron gun 6 for generating three electron beams 7, 8 and 9 which extend in one plane, the in-line plane which in this case is the plane of the drawing. A display screen 10 is located on the inside surface of the display window. Said display screen 10 comprises a large number of phosphor elements luminescing in red, green and blue. On their way to the display screen 10, the electron beams 7, 8 and 9 are deflected across the display screen 10 by means of deflection system 11 and pass through a colour selection electrode 12 which is arranged in front of the display window 3 and which comprises a thin plate having apertures 13. The colour selection electrode is suspended in the display window by means of suspension means 14. The three electron beams 7, 8 and 9 pass through the apertures 13 of the colour selection electrode at different angles and, consequently, each electron beam impinges on phosphor elements of only one colour. The plane in which the undeflected electron beams lie extends parallel to the short axis of the display screen. The deflection system 11 comprises a first deflection coil system 11*a* for generating, in the energized state, a substantially pincushion-shaped line deflection field for deflection in the direction of the short axis of the display screen, and a second deflection coil system 11*b* for generating, in the energized state, a substantially barrel-shaped vertical deflection field for deflection in the direction of the long axis of the display screen. In comparison with conventional display devices, this amounts to a 90° rotation of the plane of the gun and the deflection system.

Figure 2A:
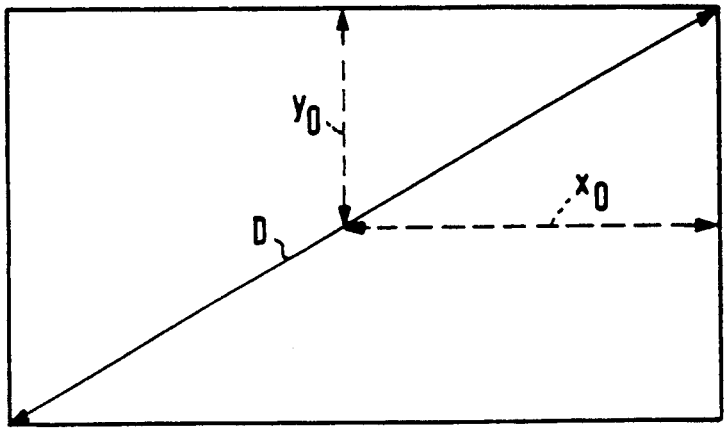
FIGS. 2*a* and 2*b* diagrammatically show an inside surface of display window which is suitable for a display device according to the invention.

FIG. 2*a* is an elevational view of an inside surface of a display window of a display device according to the invention. Said inside surface comprises a display screen 10. Half the length of the short axis is $y_0$, half the length of the long axis is $x_0$, the length of the diagonal is D.

Figure 2B:
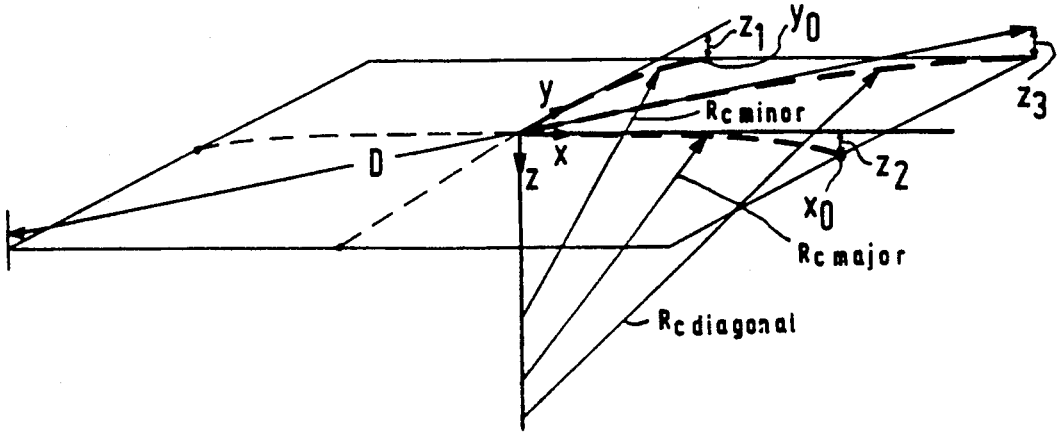

FIG. 2*b* diagrammatically shows a partly perspective elevational view of an inside surface of a display window which is suitable for a cathode ray tube according to the invention. In said Figure are indicated: the short axis (y), the long axis (x), the sagittal height z, the radius of curvature along the short axis ($R_{cminor}$), the radius of curvature along the long axis ($R_{cmajor}$), the radius of curvature along the diagonal ($R_{cdiagonal}$), the y-value at the end of the short axis ($y_0$), the sagittal height at the end of the short axis ($z_1$), the x-value at the end of the long axis ($x_0$), the sagittal height at the end of the long axis ($z_2$), the length of the diagonal D and the sagittal height at the end of the diagonal ($z_3$). All the above quantities relate to the inside surface of the display window. It is noted that the indicated radii of curvature are average radii of curvature along the short axis, the long axis and the diagonal, the value of which can be calculated from the length of the axes and the sagittal heights at the end of the axes. Viewed along each of said axes, the radius of curvature may exhibit a variation with respect to said average value. The end of the long axis, short axis and diagonal is given by the end of the display screen along said axes.

A display device according to the invention is characterized in that the inside surface of the display window complies with the formula:

$$1.1 < R_{cminor}/D < 2.5.$$

and with $$2.5 < R_{cmajor}/D$$

$$R_{cmajor} > A * R_{cminor}$$

and $$A \leqq 4/3,$$

where A is the aspect ratio.

The invention is inter alia based on the following insights:

Raster distortions can be corrected by electronically correcting the deflection of the electron beams. In conventional display devices, in particular, raster distortion in the vertical direction (North-South direction) (along the short axis) is most noticeable and correction is problematic because it requires a high-frequency correction (with a frequency equal to the line frequency) of the low-frequency vertical deflection field. In future HDTV systems using higher scanning frequencies and, for some types, an increased aspect ratio A, and with higher demands imposed on picture reproduction, this problem will become even more prominent than in conventional TV systems.

An analysis carried out within the framework of the invention shows that in a conventional display device the raster distortion in the North-South direction complies with the equation:

$$\Delta_{NS} = \delta'_1 * x^2 + \delta'_2 * x^2 * y^2 + \delta'_3 * x^4 + \text{higher-order terms},$$

In known display devices, the lowest-order term $\delta'_1 * x^2$ at the end of the long axis (where x is then maximal) is approximately equal to 4%.

If the deflection system and, in the case of colour display devices having an in-line electron gun, the plane of the gun are rotated, the most important problem as regards raster distortion then becomes the raster distortion in the horizontal direction (along the long axis). Correction of said raster distortion requires a high-frequency correction of a low-frequency signal. An analysis of said raster distortion, carried out within the framework of the invention, which raster distortion will hereinafter also be referred to as $\Delta_{EW}$, teaches that $\Delta_{EW}$ is given by:

$$\Delta_{EW} = \delta_1 * y^2 + \delta_2 * y^2 * x^2 + \delta_3 * y^4 + \text{higher-order terms},$$

where $\delta_1$, $\delta_2$ and $\delta_3$ are constants.

An electronic correction of said raster distortion can be carried out in a simple manner when the lowest order term is small. In the case of a large value of the lowest-order term, the resultant raster distortion can only partly be compensated by higher-order terms (the terms with $\delta_2$ and $\delta_3$ and higher-order terms) and only in a part of the screen. With respect to the indicated range of $R_{cminor}/D$, $\delta_1 y^2$ is smaller than approximately 2% at the end of the short axis when the deflection fields are rotated relative to the conventional display devices. In the case, the raster distortion can be compensated to a high degree over the entire screen.

As follows from an analysis carried out within the framework of the invention, $\delta_1 y^2$ can be written in a first-order approximation as:

$$\delta_1 y^2 = (K_1 - C_{02}/L) y^2$$

where L is the distance between the deflection point and the centre of the display screen, $K_1$ is a quantity which is governed by the deflection system and the sagittal height z of the inside surface of the display window is written as or expressed by:

$$z = \Sigma C_{ij} x^i y^j$$

where $C_{ij}$ are constants.

Various deflection systems have been analysed. Said analyses show that $K_1$ ranges between $0.2L^{-2}$ and $0.1L^{-2}$ and is generally about $0.15L^{-2}$. The curvature along the short axis is given by:

$$z = C_{02} y^2 + C_{04} y^4 + \text{higher-order terms}.$$

The average radius of curvature $R_{cminor}$ along the short axis is defined by:

$$(R_{cminor} - z_1)^2 + y_0^2 = R^2_{cminor}$$

where $z_1$ and $y_0$ are the sagittal height and the y-value, respectively, at the end of the short axis.

Comparing said formula with the preceding formula gives $$C_{02} \approx (2R_{cminor})^{-1}.$$

Further, there is approximately the following connection between L and the diagonal D:

$$1.15 \approx D/(2L)$$

and for the y-value at the end of the short axis ($y_0$) it holds that:

$$Y_0^2 = 1/4D^2/(A^2+1)$$

When $R_{cminor}/D$ ranges between approximately 1.1 and 2.5, $\delta_1 y_0^2$, i.e. the maximum value of the first-order term in $\Delta_{EW}$, is smaller than approximately 2%. $\delta_1 y_0^2$ is minimal when $R_{cminor}/D$ is approximately equal to 1.5. Thus, $R_{cminor}/D$ is preferably approximately equal to 1.5, for example between 1.3 and 1.7.

The sagittal height $z_1$ at the end of the short axis is given by:

$$z_1 \approx C_{02} y_0^2 \approx (2R_{cminor})^{-1} y_0^2 = D^2/(8*(1+A^2)*R_{cminor})$$

When the aspect ratio A is equal to 4/3, $z_1$ ranges between 0.026D and 0.035D if $R_{cminor}/D$ ranges between 1.3 and 1.7. When the aspect ratio is equal to 16/9, $z_1$ ranges between 0.017D and 0.023D.

In a display device according to the invention, it holds for the inner radius of curvature along the long axis of the display screen $R_{cmajor}$ and the aspect ratio A of the display screen that:

$$2.5 < R_{cmajor}/D$$

$$R_{cmajor} > A*R_{cmajor}$$

and $$A \geqq 4/3.$$

The radius of curvature along the long axis is defined by:

$$(R_{cmajor} - z_2)^2 + x_0^2 = R^2_{cmajor},$$

where $z_2$ is the sagittal height at the end of the long axis.

The above-mentioned analysis shows that both $\delta_1$ and $\delta_3$ are independent of $C_{20}$ and of $C_{40}$, i.e. they are independent of the curvature along the long or x-axis and $\delta_2$ is only slightly governed by $C_{20}$ and $C_{22}$. This enables a flatter construction of the display screen in the horizontal direction than in conventional display screens, without the raster distortion being very adversely affected. In the area indicated for $R_{cmajor}$, the display window is of a flatter construction in the horizontal direction than conventional display windows. In particular, the ratio $R_{cmajor}/R_{cminor}$ is greater than usual. Usually, said ratio is approximately 1 A=4/3 and approximately $\sqrt{A}$ for A =16/9. The indicated condition for $R_{cminor}$, $R_{cmajor}$ and A strengthen the impression that the display screen is flat because the sagittal height $z_1$ at the end of the short axis and the sagittal height $z_2$ at the end of the long axis differ only slightly from each other. The invention is particularly suitable for display tubes complying with $A \geqq 5/3$.

A further preferred embodiment of the invention is characterized in that:

$$A^{3/2} R_{cminor} < R_{cmajor} \leqq A^2 R_{cminor}$$

In this case the sagittal heights $z_1$ and $z_2$ are almost equal. This strengthens the impression that the display window is flat.

A preferred embodiment of the display device according to the invention is characterized in that:

$$2.5 < R_{cdiagonal}/D$$

and $$R_{cdiagonal} > \sqrt{(A^2+1)} * R_{cminor}$$

where $R_{cdiagonal}$ is the radius of curvature along the diagonal of the display screen. The radius of curvature along the diagonal is defined by:

$$(R_{cdiagonal} - z_3)^2 + D^2/4 = R^2_{cdiagonal}$$

where $z_3$ is the sagittal height at the end of the diagonal.

Said embodiment is based on the insight that $\Delta_{EW}$ is governed only to a small degree by the radius of curvature along the diagonal so that the display window can be of a flatter construction along the diagonal than conventional display windows. Preferably, it holds that:

$$R_{cmajor} \leqq R_{cdiagonal} \leqq (1+A^{-2}) * R_{cmajor}$$

In this case, the sagittal heights at the end of the long axis and at the end of the diagonal are substantially equal.

Preferably, the sagittal height along the short sides of the display window is approximately constant, i.e. it varies less than 5% relative to the distance between the end of the long axis and the end of the diagonal, which distance is equal to half the length of the short axis in the case of a rectangular display window. If the sagittal height along the short side is not constant, a straight line along said short side is perceived as as a curved line by a viewer watching the display window at an angle. This leads to an apparent raster distortion. This effect is small when the sagittal height is approximately constant along the short sides. The apparent raster distribution is most clearly visible along the short sides because, in general, the divergence of the viewing angle is much greater in the horizontal direction than in the vertical direction.

Preferably, the sagittal height along the edges is approximately constant, which gives the display window a very flat appearance and reduces the apparent raster distortion along the sides.

An example of an inside surface of a display window which is suitable for a device according to the invention is an inside surface for which it holds that:

$R_{cminor}$=1140 mm
$R_{cmajor}$=2329 mm
$R_{diagonal}$=3060 mm
half the length of the short axis $y_0$=210.8 mm
half the length of the long axis $x_0$=375 mm
A=ratio of long axis/short axis=16/9
length diagonal D=860 mm For this surface it holds that:

(a)

$$1.1 < R_{cminor}/D = 1.33 < 2.5$$

$$R_{cmajor}/D = 2.71 > 2.5$$

$$R_{cmajor} = 2.71D > A*R_{cminor} = 16/9*R_{cminor} = 2.36D$$

(b)

$$R_{cmajor} = 2.71D \leqq A^2 R_{cminor} = 4.20D$$

(c)

$$2.5 < R_{cdiagonal}/D = 3.56$$

$$R_{cdiagonal} = 3.56D > \sqrt{(A^2+1)} * R_{cminor} = 2.70D$$

(d)

$$R_{cmajor} = 2.71D \leqq R_{cdiagonal} = 3.56D \leqq (1+A^{-2}) R_{cmajor} = 3.57D$$

The sagittal height at the end of the short axis is 19.67 mm, at the end of the long axis the sagittal height is 30.39 mm and at the end of the diagonal the sagittal height is also 30.39 mm. The sagittal height along the short side is substantially constant. The advantage of a substantially constant sagittal height along the short side has been described above. The lowest-order term of $\Delta_{EW}$ is approximately equal to 0.1%.

In a second example it holds that:

$R_{cminor}=1139$ mm $R_{cmajor}=3060$ mm $R_{diagonal}=3060$ mm half the length of the short axis $y_0=210.8$ mm half the length of the long axis $x_0=375$ mm ratio of long axis/short axis=16/9 length diagonal D=860 mm it holds that $$1.1<R_{cminor}/D=1.32<2.5$$

$$R_{cmajor}/D=3.56>2.5$$

$$R_{cmajor}=3.56D>A*R_{cminor}=16/9*R_{cminor}=2.34D$$

$$A^{3/2}R_{cminor}=3.15D<R_{cmajor}=3.56D<A^2R_{cminor}=4.19D$$

$$2.5<R_{cdiagonal}/D=3.56$$

$$R_{cdiagonal}=3.56D>\sqrt{(A^2+1)}*R_{cminor}=2.70D$$

The sagittal heights at the end of the short axis and the diagonal are approximately equal to the sagittal heights given in the first example. This example differs from the second example in that the sagittal height at the end of the long axis has changed. The sagittal height along the short side exhibits a variation of approximately 3.5% of half the length of the short axis. The lowest-order term of $\Delta_{EW}$ is approximately equal to 0.5%.

It is possible to produce a display window the sagittal height of which is substantially constant along all sides, and in which additionally $R_{cdiagonal}$ is greater than 2.5 D. This gives the impression that the display window is very flat.

It is noted that in a conventional type of display device, i.e. a display device in which the plane of the gun and the deflection system are not rotated, the attainment of a raster distortion of the same order of magnitude which can be corrected in an approximately equally simple manner, requires the sagittal height at the edges to be approximately a factor of $A^2$ greater. Since the shape of the outside surface roughly follows the shape of the inside surface, such a display window must have a very convex shape.

It will be obvious that within the scope of the invention many variations are possible to those skilled in the art.

I claim:

1. A display device comprising a display tube having a rectangular display window with a short axis and a long axis and a display screen provided on an inner surface of the display window, electron gun means for generating at least one electron beam directed toward the display screen, and a deflection system located between the electron gun means and the display screen for deflecting the electron beam to produce a scanning line raster on the display screen; characterized in that:

the deflection system comprises a first and a second deflection coil, the first deflection coil when energized producing a substantially pincushion-shaped deflection field for deflecting the electron beam along scan lines parallel to said short axis of the display window, the second deflection coil when energized producing a substantially barrel-shaped deflection field for deflecting the electron beam in a direction parallel to said long axis of the display window;

the display window has a radius of curvature $R_{cminor}$ along the short axis thereof which is given by:

$$1.1<R_{cminor}/D<2.5$$

where D is the length of the diagonal of the display window; and the display window has a radius of curvature $R_{cmajor}$ along the long axis thereof and an aspect ratio A corresponding to the ratio of the long axis to the short axis, given by:

$$2.5<R_{cmajor}/D$$

$$R_{cmajor}>A*R_{cminor}$$

and $$A\geqq 4/3.$$

2. A display device as claimed in claim 1 characterized in that:

$$A^{3/2}R_{cminor}<R_{cmajor}<A^2R_{cminor}.$$

3. A display device as claimed in claim 1 or 2, characterized in that $$2.5 < R_{cdiagonal}/D$$

and $$R_{cdiagonal} > \sqrt{(A^2+1)}*R_{cminor}$$

where $R_{cdiagonal}$ is the radius of curvature along the diagonal of the display screen.

4. A display device as claimed in claim 1, characterized in that $$R_{cmajor}<R_{cdiagonal}<(1+A^{-2})*R_{cmajor}.$$

5. A display device as claimed in claim 4, characterized in that the sagittal height along the short sides of the display window is approximately constant.

6. A display device as claimed in claim 5, characterized in that the sagittal height is also approximately constant along the long sides of the display window.

7. A display device as claimed in claim 1 characterized in that the aspect ratio A is greater than or equal to 5/3.

8. A display device as claimed in claim 1, characterized in that the long axis of the display window is in the horizontal direction and line scanning is effected in the vertical direction.

* * * * *